United States Patent [19]

Bohannan

[11] 4,407,476

[45] Oct. 4, 1983

[54] COMBINED SHELF AND CLOTHES BAR ASSEMBLY

[75] Inventor: Jerry L. Bohannan, Glendora, Calif.

[73] Assignee: Acme General Corporation, San Dimas, Calif.

[21] Appl. No.: 346,527

[22] Filed: Feb. 8, 1982

[51] Int. Cl.[3] ..... A47G 29/02

[52] U.S. Cl. ..... 248/235; 108/152; 211/90; 248/250

[58] Field of Search ..... 248/235, 250; 108/108, 108/107, 152; 211/135, 123, 153, 90; 52/821, 822, 823, 826; 312/321, 140

[56] References Cited

U.S. PATENT DOCUMENTS

| | | | |
|---|---|---|---|
| 3,102,499 | 9/1963 | Shelor | 108/108 X |
| 3,220,363 | 11/1965 | Gingher | 108/152 X |
| 3,284,040 | 11/1966 | Marontate . | |
| 3,437,214 | 4/1969 | Sainsbury | 108/152 X |
| 3,563,182 | 2/1971 | MacFarlane et al. . | |
| 3,669,395 | 6/1972 | Gehrke | 248/235 |
| 3,865,336 | 2/1975 | Robertson . | |
| 4,285,484 | 8/1981 | Follows | 248/235 |

*Primary Examiner*—James T. McCall
*Assistant Examiner*—David Lee Talbott
*Attorney, Agent, or Firm*—Christie, Parker & Hale

[57] ABSTRACT

A combined shelf and clothes bar assembly is adapted for fastening to the walls of different sized clothes closets for supporting a shelf panel and a hanger bar that can both be cut to match the width of the closet. The assembly includes a pair of elongated front and rear edge cleats of generally E-shaped cross-section for being secured to the front and rear edges of the shelf panel. The edge cleats can be cut to match the length of the shelf panel. The edge cleats have elongated channels that slidably engage the front and rear edges of the shelf, and inwardly facing lower flanges spaced below the underside of the shelf. A pair of outer shelf support brackets have slots for slidably receiving opposite end portions of the shelf panel and the channel and lower flange portions of the edge cleats. A center support bracket supports the shelf panel. The center bracket has slotted front and rear edges for slidably engaging the lower flanges of the edge cleats so the center bracket can slide lengthwise along the lower flanges below the shelf panel. The outer shelf support brackets and the center support bracket carry hanger bar sockets spaced below the shelf panel. The hanger bar passes through the socket on the center support bracket and is inserted in the sockets on the outer support brackets for supporting the hanger bar below the shelf. The outer support brackets are fastened to the end walls of the closet and the center support bracket is fastened to a back wall of the closet. One end of a diagonal shelf brace snap locks into engagement with a socket on the center support bracket and an opposite end of the diagonal brace is fastened to the back wall of the closet for adding stiffness to the assembled shelf.

18 Claims, 4 Drawing Figures

COMBINED SHELF AND CLOTHES BAR ASSEMBLY

BACKGROUND OF THE INVENTION

1. Field of the Invention

This invention relates to a combined shelf and clothes bar assembly adapted for installation in various sized clothes closets.

2. Description of the Prior Art

It often becomes necessary to install additional shelves and clothes hanger bars in the clothes closets of new and used houses as well as hotels. It would be desirable to provide a combined shelf and clothes hanger bar that can be readily installed in existing clothes closets of different widths, without the need for special tools, or other hinderances that makes installation difficult.

Some prior art shelving is difficult to install and too cumbersome to adapt to closets of different sizes. Some prior art shelving is too complicated in structure, and therefore too costly. Those requiring telescoping shelves braces and hanger bars are one example. Other prior art shelving is too complicated because it requires fasteners or complex means of attachment between the shelving and hanger bar and the bracing that is attached to the shelf.

It is important to provide a combined shelf and hanger bar that can be assembled in a rattle-proof configuration, as well as being sturdy enough to carry reasonably heavy loads.

The present invention fulfills these needs for a combined shelf and hanger bar assembly that can be readily installed in clothes closets of different sizes. The assembly is especially designed for ease of installation and requires no special tools and no fasteners or other complicated means of attaching the shelf and hanger bar to the shelf support brackets. The only need for fasteners is for securing the shelf support brackets to the walls of the closet.

SUMMARY OF THE INVENTION

One embodiment of this invention provides a combined shelf and hanger bar assembly for supporting a flat shelf panel having front and rear edges. The assembly comprises a pair of elongated edge cleats each having an elongated channel for encompassing one of such edges of the shelf panel and a stiffening flange for extending normal to the shelf panel for stiffening of the shelf. A pair of outer shelf support brackets each have a socket for receiving an end of a shelf panel and an end of each of the edge cleats encompassing a shelf panel. The socket includes means for limiting raising of a shelf panel and means for preventing removal of the edge cleat from the front edge of the shelf panel. A hanger bar socket integral with each shelf support brackets encompasses an end portion of a hanger bar.

In the assembly of this invention, the shelf panel, the edge cleats and the hanger bar can be cut to a length that matches the width of the closet. The edge cleats can be slidably engaged with the front and rear edges of the shelf, and the shelf support brackets and hanger bar assembled onto the shelf assembly as a fixed unit without requiring fasteners, such as screws or the like, for securing the parts together. This enables the components to be quickly and easily assembled and installed in closets of various sizes.

These and other aspects of the invention will be more fully understood by referring to the following detailed description and the accompanying drawings.

DRAWINGS

DETAILED DESCRIPTION

Figure 1:
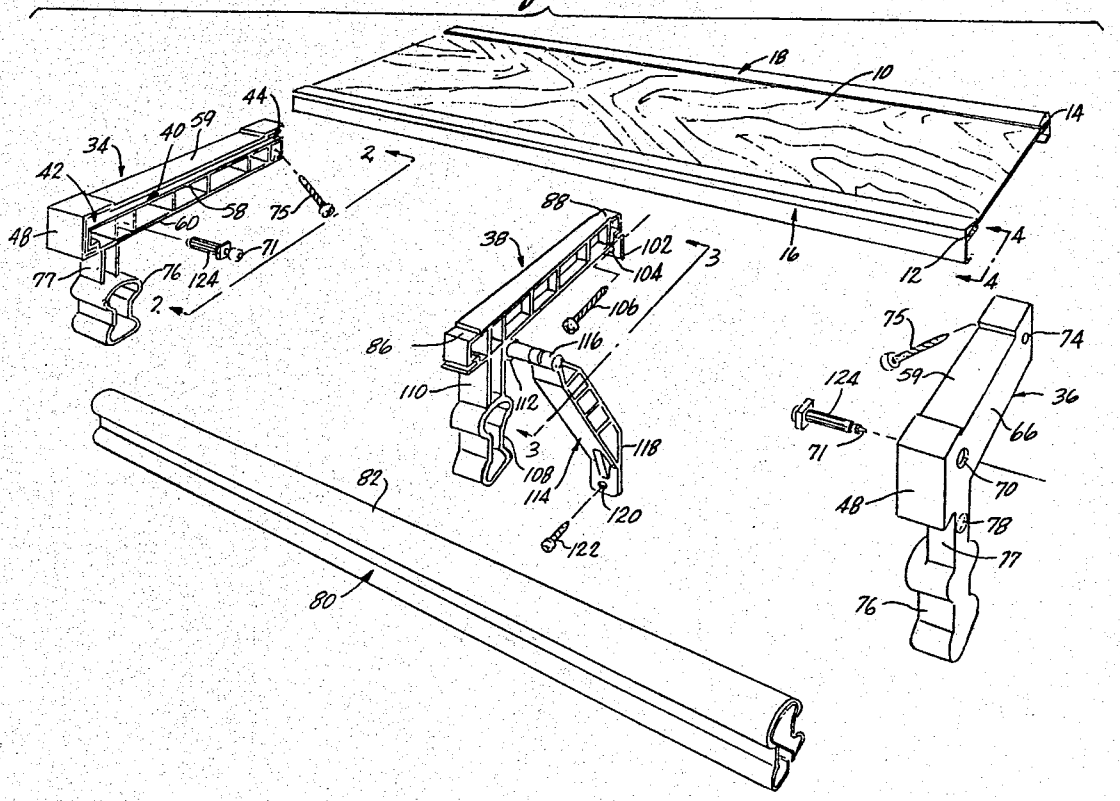
FIG. 1 is an exploded perspective view showing components of a combined shelf and hanger bar assembly according to principles of this invention.

FIG. 1 is an exploded perspective view showing components of a shelf and hanger bar assembly for being installed in a clothes closet, for example. The assembly includes an elongated rectangular shelf panel 10 having parallel front and rear edges 12 and 14, respectively. The shelf panel is made of a relatively thin but rigid sheet material. The user simply cuts the shelf material to match the width of the closet in which the shelf assembly is being installed. The shelf panel material is preferably made of wood, although any reasonably rigid thin sheet material can be used. In one embodiment, the wooden shelf panel is about 5/32 to 3/16 inch thick and approximately 12 inches wide.

Figure 4:
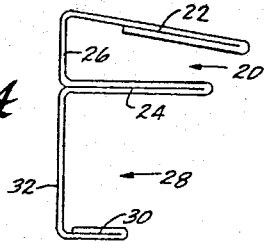
FIG. 4 is an elevation view taken on line 4—4 of FIG. 1 showing the cross-sectional configuration of an edge cleat.

Separate elongated front and rear edge cleats 16 and 18 are secured to the front and rear edges, respectively, of the shelf panel. The front and rear edge cleats are identical, and in the illustrated embodiment, each edge cleat is generally E-shaped in cross-section. The edge cleats are made from a relatively rigid material that can be cut by the user to match the length of the shelf panel. FIG. 4 shows the generally E-shaped cross-section of each edge cleat, which includes an elongated upper channel 20 of generally U-shaped cross-section extending along the upper portion of the edge cleat. The upper channel is formed by an upper flange 22 and an intermediate flange 24 facing in the same direction from an upper bight portion 26 of the edge cleat. An elongated lower channel 28 of generally U-shaped cross-section extends along the lower portion of each edge cleat. The lower channel is formed between the intermediate flange 24 and a lower flange 30 which both face in the same direction from a lower bight portion 32 of the edge cleat.

In one embodiment, the edge cleat is made of spring steel, preferably 24 gauge cold rolled steel which is bent and shown in FIG. 4 to provide flanges of double thickness. The lower and intermediate flanges are essentially perpendicular to the bight portions of the edge cleat, and the upper flange tapers downwardly and outwardly toward the intermediate flange to form an upper channel that decreases in width in a direction away from the bight portion of the upper channel. The narrow portion of the upper channel has a width which is less than the width of the shelf panel, and in the illustrated embodiment, the width of the narrow portion of the upper channel is approximately 0.135 inch. The shelf panel can be inserted in the upper channel of each edge cleat and the panel can be slid lengthwise along each upper channel so that the front and rear edge cleats extend continuously from end to end along the front and rear edges of the panel, with the flanged portions of the upper channel making a tight frictional fit around each edge of the panel. The upper flanges of the edge cleats are spread apart from the intermediate flanges when the shelf panel is inserted in the upper channel so that the flanges of the upper channel normally apply a spring-biased pressure to the opposite faces of the panel for making a snug frictional fit along opposite edges of the panel. The lower channel portions of the edge cleats provide stiffening for the shelf panel. The exploded view of FIG. 1 shows the front and rear edge cleats secured to the front and rear edges of the shelf panel.

Figure 2:
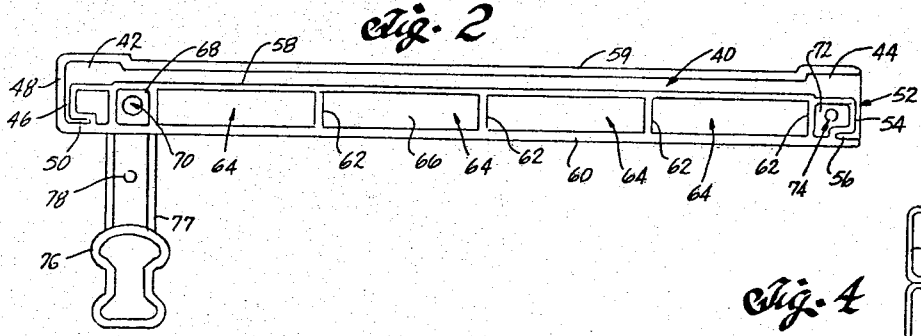
FIG. 2 is an elevation view taken on line 2—2 of FIG. 1 and showing an outer shelf support bracket.

Referring to FIG. 1, left and right outer shelf support brackets 34 and 36 support the left and right outer portions, respectively, of the shelf panel. A center shelf and hanger bar support bracket 38 supports a central portion of the shelf panel FIG. 2 illustrates the detailed construction of the left outer shelf support bracket, which is identical to the right outer shelf support bracket, except that the two outer support brackets are the mirror image of each other. Each outer support bracket is a relatively narrow, elongated piece of generally rectangular cross-section. The outer support brackets are preferably molded as complex shapes from a plastic material, such as high impact polystyrene. Each outer support bracket, when viewed from the side, as in FIG. 2, includes an elongated shelf slot that forms a socket for receiving an end portion of the shelf and the edge cleats that are attached to the front and rear edges of the shelf. The slot has a long, narrow principal portion 40 that extends for most of the length of the bracket, a generally C-shaped front end portion and a generally C-shaped rear end portion. The principal portion of the slot has a uniform width that slidably receives the end portion of the shelf panel in a snug frictional fit. The C-shaped front end portion of the slot has an enlarged upper portion 42 shaped to slidably receive the upper channel portion of the front edge cleat, and the C-shaped rear end portion of the slot has an enlarged upper portion 44 shaped to slidably receive the upper channel portion of the rear edge cleat.

The enlarged front end portion of the slot opens downwardly into a generally L-shaped groove having a narrow vertical portion 46 which extends immediately inside a front end wall 48 of the bracket. The bottom of the L-shaped groove is formed by a slotted lower portion 50 that extends away from and generally perpendicular to the vertical portion 46 of the groove. The L-shaped groove is shaped to slidably receive the lower channel portion of the front edge cleat.

The enlarged rear end portion of the slot opens downwardly into a generally L-shaped recess having a narrow vertical portion 52 adjacent a vertical wall portion 54 of the bracket that is recessed from the rear end of the bracket. The bottom of the L-shaped recess if formed by a slotted portion 56 that extends inwardly toward the slotted lower portion 50 of the groove at the opposite end of the bracket. The L-shaped recess is shaped to receive the lower channel portion of the rear edge cleat.

An elongated shelf supporting wall 58 is formed inside the outer support bracket along the bottom of the principal portion 40 of the shelf slot. The wall 58 supports the bottom outer portion of the shelf when the shelf is inserted in the shelf slot 40. An upper wall portion 59 of the bracket overlies and makes a snug fit around the shelf end portion inserted in the slot. A lower wall portion 60 is spaced below and extends parallel to the shelf supporting wall 58. Ribs 62 are spaced apart horizontally along the support bracket and are integrally molded with the shelf supporting wall 58 and the lower wall 60 to provide rigidity for the support bracket. This forms mutually spaced apart, generally rectangular-shaped recesses 64 that act as lightening holes spaced along the length of the bracket.

An end wall 66 covers the entire end of the outer shelf support bracket and acts as a stop for the shelf panel and edge cleats inserted in the shelf slot. In the illustrated embodiment, a small generally rectangular recess 68 is formed between a pair of parallel ribs 62 inboard the front end of the bracket. A hole 70 passes through the rear wall of the recess 68 and provides a means for receiving a fastener 71 (see FIG. 1) for securing the front portion of the support bracket to an end wall of the closet. A similar narrow recess 72 is formed immediately inboard the rear end of the support bracket. A hole 74 passes through the rear wall of the recess 72 and receives a fastener 75 (see FIG. 1) for securing the rear portion of the bracket to a closet end wall.

A hanger bar socket 76 is spaced below a front portion of each outer shelf support bracket. The socket is carried on the lower end of a leg 77 that is molded integrally with the bottom front portion of the outer support bracket. The leg is preferably formed as a pair of downwardly extending parallel ribs integrally formed with the top of the socket. The socket has a narrow outer wall shaped generally as an hour glass, with enlarged upper and lower portions above and below a necked-down central region. The end wall of the bracket closes off the outer end of the socket and the space between the ribs of the leg 77. A hole 78 extends through the portion of the end wall between the ribs, and a fastener (not shown) inserted through the hole 78 secures this portion of the bracket to the closet end wall.

The interior of the socket forms a receptacle for receiving one end portion of an elongated hanger bar 80. The hanger bar is preferably made from a thin wall metal such as cold rolled steel, 22 gauge thickness in one embodiment. The metal is preferably of sheet form that is roll formed into a long tubular form with a cross-sectional shape that matches the generally hour glass shape of the socket. An elongated, curved hanger bar pad 82 which is preferably made of plastic is secured to the top portion of the hanger bar. Preferably, the hanger bar pad 82 is generally C-shaped in cross-section, and opposite inwardly turned marginal end portions of the hanger bar pad can frictionally engage opposite outer wall portions of the hanger bar so the hanger bar pad can be slid lengthwise along the hanger bar to cover the top of the hanger bar from end to end. The resulting hanger bar and pad can be made of any length and can be cut by the user to a length that matches the length of the shelf being installed.

Figure 3:
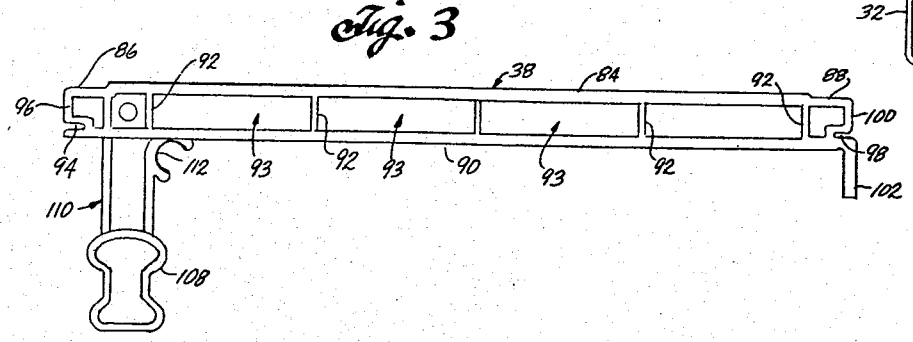
FIG. 3 is an elevation view taken on line 3—3 of FIG. 1 showing a center shelf and hanger bar support bracket.

The center shelf and hanger bar support bracket 38 is similar in construction to the outer support brackets, and its detailed construction is shown best in FIG. 3. The center shelf and hanger bar support bracket is a relatively narrow elongated piece of generally rectangular cross-section. The center bracket is preferably molded as a complex shape from a plastic material such as high-impact polystyrene. The center bracket includes an elongated shelf supporting upper wall 84 having a flat top surface that extends a principal portion of the width of the shelf panel. The upper wall of the bracket has a recessed front portion 86 that matches the shape of the intermediate flange of the front edge cleat, and a recessed rear portion 88 that matches the shape of the intermediate flange of the rear edge cleat. The length of the center bracket matches the length of the outer brackets so that the front and rear recessed portions 86 and 88 of the center bracket can be aligned with the enlarged front and rear portions 42 and 44 of the shelf slots in the outer shelf support brackets. A lower wall portion 90 of the center bracket is spaced below and extends parallel to the upper wall portion 82, and vertical ribs 92 are spaced apart horizontally along the center bracket. The ribs are integrally molded with the upper and lower wall portions to provide rigidity for the center bracket. The ribs form spaced apart lightening holes 93 in the bracket. A groove 94 formed in a front end wall 96 of the center bracket slidably receives the lower flange of the front edge cleat when the intermediate flange of the edge cleat rests on the recessed portion 86 of the center bracket. Similarly, a groove 98 is formed in a rear wall 100 of the center bracket for receiving the lower flange of the rear edge support cleat when the intermediate flange of the rear edge cleat rests on the recessed portion 88 of the center bracket. The lower flanges of the edge cleats provide guide tracks for engaging the grooves 94 and 98 of the center bracket to facilitate sliding the center bracket along the length of the shelf assembly.

A rear leg 102 projects down from the end of the center shelf and hanger bar support bracket. A flat rear face of the leg is adapted to lie flat against a back wall of the closet in which the assembly is installed. A hole 104 through the rear leg receives a fastener 106 (see FIG. 1) for securing the leg of the center bracket to the closet back wall. The rear face of the leg is offset from the rear wall 100 of the center bracket so that when the leg is fastened against the closet rear wall, the rear wall 100 is spaced from the closet back wall to accommodate the lower bight portion of the rear edge cleat.

An open ended hanger bar tube 108 is spaced below a front portion of the center shelf and hanger bar support bracket. The tube is carried on the lower end of a leg 110 that is integrally molded with the bottom front portion of the center support bracket. The tube and its support leg are similar in configuration to the socket 74 and support arm 76 of the outer support brackets, in that the support arm 110 has a pair of parallel ribs integrally molded with the top portion of the tube, and the tube is generally hour glass shaped to match the shape of the hanger bar 80.

A downwardly and inwardly facing, generally C-shaped socket 112 is formed at the juncture between the inside portion of the support leg 110 and the lower wall 90 of the center bracket. Referring to FIG. 1, the center bracket is braced by an elongated diagonal shelf brace 114 having a generally cylindrical-shaped locking element at its upper end. The locking element 116 snap locks into engagement with the socket 112. An upright rear face 118 of the diagonal brace abuts against the back wall of the closet when the locking element 116 is snapped into place in the locking joint 112. A hole 120 passes through a projecting lower portion of the diagonal brace for receiving a fastener 122 for securing the lower portion of the brace to the back wall. The diagonal brace is made from a molded plastic material such as high-impact polystyrene, with upper and lower walls that are parallel to one another, with spaced apart ribs and lightening holes in a configuration similar to the shelf support brackets.

In using the shelf and hanger bar assembly, the user initially locates the shelf height on the closet walls. Preferably, a pair of finish nails (not shown) are driven into the end walls approximately 10 inches apart. The nails protrude about ½ inch from each end wall. The width of the closet back wall is then measured and the shelf panel 10 is cut to match the width of the back wall, minus about ⅜ inch. The same measurement is used to cut the front and rear shelf cleats 16 and 18 and the hanger bar 80 and the hanger bar pad 82 to the same length. The front and rear edge cleats are then slid lengthwise along the front and rear edges of the shelf panel. The upper channel portions 20 of the edge cleats make a snug frictional fit around the front and rear edges of the shelf panel, with the edge cleats extending the full length of the panel, as shown in FIG. 1. In this configuration, the lower flanges of the front and rear edge cleats face inwardly toward each other. The shelf assembly, i.e., the shelf with the edge cleats assembled, is placed face down, and the center bracket 38 is placed diagonally between the edge cleats with the wall 48 placed flat against the shelf panel. The center bracket is then rotated in the plane of the shelf panel until the grooves 94 and 98 of the center bracket are engaged with the lower flanges of the edge cleats. The center bracket then can be slid along the length of the shelf using the lower flanges of the edge cleats as guide tracks. One of the outer shelf support brackets 34, 36 is then assembled onto one end of the shelf assembly, with the shelf panel being slidably inserted in the shelf slot 40 so the shelf panel rests on the shelf supporting wall 58 of the bracket. The edge cleats are slidably inserted in the C-shaped grooved outer portions of the shelf slot, where the enlarged outer portions 42 and 44 of the slot receive the upper channel portions of the edge cleats, and the lower channel portions 28 of the edge cleats slide into the L-shaped groove and recess on opposite ends of the outer support bracket. The rear wall 66 of the outer support bracket provides a stop for the shelf assembly being inserted into the bracket, and the shelf assembly is held in the bracket in a tight frictional fit. The hanger bar 80 is then threaded through the opening in the hanger bar tube 108 of the center shelf support bracket. One end of the hanger bar is inserted into the hanger bar socket 76 in the same outer support bracket. The other outer support bracket is then assembled over the other end of the shelf assembly, with the opposite end of the hanger bar being inserted in the hanger bar socket of the other bracket. The hanger bar, owing to its cross-sectional shape, does not rotate relative to the hanger bar holders, and the entire assembly is held together as a rattle-proof unit. The assembled shelf and hanger bar assembly is then placed in the closet by resting the bottom portions of the outer support brackets on the finish nails previously driven into the end walls of the closet. The mounting holes 70, 74 and 78 are then located on the end walls of the closet, the assembly is removed, and mounting holes are then drilled through the end walls of the closet. The shelf is then replaced in position and mounted to the wall using wall anchors, such as anchors 124 shown in FIG. 1, along with fasteners 71 and 75 shown in FIG. 1. The mounting holes 74 at the rear portions of the outer support brackets accommodate mounting the rear portions of the brackets and woodscrews 75 at approximately 45° angles relative to the plane of the closet end wall. The stud for the closet rear wall is then located and the center bracket is slid lengthwise relative to the shelf so that the mounting hole 104 in the rear leg of the center bracket is aligned with the stud. The mounting screw 106 is then driven through the leg 102 of the brace and into the stud. The diagonal shelf brace 114 is then snap locked into engagement with the socket 112 of the center support bracket, and the face 118 of the diagonal shelf brace is aligned with the stud and mounted to the rear wall using the fastener 122. The end brackets 34 and 36 support opposite ends of the shelf and hold opposite ends of the hanger bar. The center bracket 38 supports intermediate portions of the shelf and the hanger bar. The center support for the hanger bar is particularly important for hanger bars having a length exceeding about four feet.

Thus, the invention provides a shelf and hanger bar assembly that can be easily assembled and installed in closets of different widths. No special tools are required to assemble the shelf and hanger bar, inasmuch as all components fit together in a tight frictional fit without fasteners such as screws or the like.

What is claimed is:

1. A shelf assembly for supporting a flat shelf panel having front and rear edges, comprising:

a pair of elongated edge cleats each having an elongated channel for encompassing one of such edges of the shelf panel and a stiffening flange for extending normal to the shelf panel for stiffening of the shelf, in which the edge cleats have lower flanges extending generally normal to the stiffening flanges;

a pair of outer shelf support brackets each having a socket for receiving an end of a shelf panel and an end of each of the edge cleats encompassing a shelf panel, the socket including means for limiting raising of the shelf panel and means for preventing removal of the edge cleat from the front edge of a shelf panel; and a center support bracket having an upper surface for supporting the underside of the shelf panel and slotted front and rear portions for slidably receiving the lower flanges of the edge cleats so the center support bracket is slidable lengthwise with respect to the shelf along the lower flanges of the edges cleats;

an elongated hanger bar; and a hanger bar socket integral with each shelf support bracket for encompassing an end portion of the hanger bar.

2. Apparatus according to claims 1, including a hanger bar socket carried on the center support bracket and spaced below the center support bracket, the socket being shaped to match the cross-sectional shape of the hanger bar for slidably receiving the hanger bar to support the hanger bar.

3. Apparatus according to claim 1 including an elongated shelf brace, and means for releasably interlocking the shelf brace with the center support bracket so the shelf brace is spaced below but extends in the same general direction as the center support bracket.

4. Apparatus according to claims 1 in which each edge cleat is of generally E-shaped cross-section forming separate elongated channels for slidably engaging the front and rear edges of a shelf panel, each edge cleat having a lower flange spaced below the underside of the shelf panel and extending generally parallel to the shelf panel; and in which the socket of each outer shelf support bracket comprises an elongated slot for slidably receiving an end portion of a shelf panel so that a surface portion of the bracket adjacent the slot supports the underside of the shelf panel, the slot have generally C-shaped front and rear slotted end portions for receiving the channel and lower flange portions of the front and rear edge cleats.

5. Apparatus according to claim 1 in which the channel portion of each edge cleat is formed by converging flanges that are spread apart when a shelf panel is inserted between the flanges to provide frictional contact between the shelf panel and the portion of the edge cleat along the length of the shelf panel.

6. A shelf assembly for supporting an elongated shelf panel having front and rear edges comprising:

a pair of elongated front and rear edge cleats of generally E-shaped cross-section forming separate elongated channels each for slidably engaging corresponding front and rear edge portions of a shelf panel so the edge cleats extend along the front and rear edges of the shelf panel, with each edge cleat having a lower flange spaced below the underside of the shelf panel;

a pair of outer shelf support brackets each forming a socket for receiving a respective end portion of a shelf panel and the edge cleats secured to the front and rear edges of the shelf panel, the socket in each outer support bracket comprising an elongated slot for slidably receiving said end portion of the shelf panel so that a surface portion of the bracket adjacent the slot supports the underside of the shelf panel, the slot having generally C-shaped front and rear slotted end portions for receiving the channel and lower flange portions of the front and rear edge cleats;

an elongated hanger bar; and a separate hanger bar socket carried on each outer shelf support bracket, each hanger bar socket being spaced below the outer support bracket and being shaped to match the cross-sectional shape of the hanger bar for slidably receiving opposite end portions of the hanger bar.

7. Apparatus according to claim 6 including a center support bracket having an upper surface for supporting the underside of a shelf panel, and slotted front and rear end portions for slidably receiving the lower flanges of the front and rear edge cleats when the edge cleats are secured to the front and rear edge portions of the shelf panel, so the center support bracket is slidable lengthwise with respect to the shelf along the lower flanges of the edge cleats.

8. Apparatus according to claim 7 including a hanger bar socket carried on the center support bracket and spaced below the center shelf support bracket, the socket being shaped to match the cross-sectional shape of the hanger bar for slidably receiving the hanger bar to support the hanger bar.

9. Apparatus according to claim 8 including an elongated shelf brace, and means for releasably interlocking the shelf brace with the center support bracket so the shelf brace is spaced below but extends in the same general direction as the center support bracket.

10. Apparatus according to claims 6, 7 and 8 in which the hanger bar socket and the hanger bar are shaped to prevent relative rotation between the hanger bar and the hanger bar socket.

11. Apparatus according to claims 6, 7 or 8 in which the channel portion of each edge cleat is formed by converging flanges that are spread apart when a shelf panel is inserted between the flanges to provide frictional contact between the shelf panel and the channel portion of the edge cleat along the length of the shelf panel.

12. Apparatus according to claims 6, 7 or 8 in which the slotted portion of the sockets in the outer shelf support bracket closely match the wall thickness of a shelf panel and the C-shaped slotted end portions of the socket closely match the shape of the front and rear edge slots when secured to the front and rear edges of the panel, so the panel and the edge cleats make a snug frictional fit in each socket of the outer shelf support brackets.

13. Apparatus according to claim 6 including a center support bracket having an upper portion for supporting the underside of a shelf panel and a lower portion for supporting the hanger bar.

14. A shelf assembly for supporting a flat shelf panel having front and rear edges, comprising:

a pair of elongated edge cleats each having an elongated channel for encompassing one of such edges of the shelf panel and a stiffening flange for extending normal to the shelf panel for stiffening of the shelf, in which each edge cleat is of generally E-shaped cross-section forming separate elongated channels for slidably engaging the front and rear edges of the shelf panel, each edge cleat having a lower flange spaced below the underside of the shelf panel and extending generally parallel to the shelf panel;

a pair of outer shelf support brackets each having a socket for receiving an end of the shelf panel and an end of each of the edge cleats encompassing the shelf panel, the socket including means for limiting raising of the shelf panel and means for preventing removal of the edge cleat from the front edge of the shelf panel, in which the socket of each outer shelf support bracket comprises an elongated slot for slidably receiving an end portion of the shelf panel so that a surface portion of the bracket adjacent the slot supports the underside of the shelf panel, the slot having generally C-shaped front and rear slotted end portions for receiving the channel and lower flange portions of the front and rear edge cleats;

an elongated hanger bar; and a hanger bar socket integral with each shelf support bracket for encompassing an end portion of the hanger bar.

15. Apparatus according to claim 14 including a center support bracket having an upper surface for supporting an underside of the shelf panel, and means for securing the center support bracket to the stiffening flanges of the edge cleats.

16. Apparatus according to claim 14 in which the edge cleats have lower flanges extending generally normal to the stiffening flanges; and including a center support bracket having an upper surface for supporting the underside of the shelf panel and slotted front and rear end portions for slidably receiving the lower flanges of the edge cleats so the center support bracket is slidable lengthwise with respect to the shelf along the lower flanges of the edge cleats.

17. Apparatus according to claim 14 including a center support bracket having an upper portion for supporting an underside of the shelf panel and a lower portion for supporting the hanger bar.

18. A shelf assembly for supporting a flat shelf panel having front and rear edges, comprising:

a pair of elongated edge cleats each having an elongated channel for encompassing one of such edges of the shelf panel and a stiffening flange for extending normal to the shelf panel for stiffening to the shelf, in which the edge cleats have lower flanges extending generally normal to the stiffening flanges;

a pair of outer shelf support brackets each having a socket for receiving an end of the shelf panel and an end of each of the edge cleats encompassing the shelf panel, the socket including means for preventing removal of the edge cleat from the front edge of the shelf panel; and a center support bracket having an upper surface for supporting the underside of the shelf panel and slotted front and rear end portions for slidably receiving the lower flanges of the edge cleats so the center support bracket is slidable lengthwise with respect to a shelf along the lower flanges of the edge cleats.

* * * * *